US008207803B2

(12) United States Patent
Iwamoto et al.

(10) Patent No.: US 8,207,803 B2
(45) Date of Patent: Jun. 26, 2012

(54) ELECTROMAGNETIC RELAY

(75) Inventors: Daiei Iwamoto, Shinagawa (JP); Takashi Yuba, Shinagawa (JP); Satoshi Takano, Shinagawa (JP); Hirofumi Saso, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 169 days.

(21) Appl. No.: 12/543,547

(22) Filed: Aug. 19, 2009

(65) Prior Publication Data

US 2010/0066468 A1 Mar. 18, 2010

(30) Foreign Application Priority Data

Sep. 16, 2008 (JP) ..... 2008-236192

(51) Int. Cl.
*H01H 51/22* (2006.01)

(52) U.S. Cl. ..... 335/78; 335/128

(58) Field of Classification Search ..... 335/78–86, 335/128–130

See application file for complete search history.

(56) References Cited

U.S. PATENT DOCUMENTS

| | | | | |
|---|---|---|---|---|
| 2,279,404 | A * | 4/1942 | Lakatos | 335/85 |
| 3,657,673 | A * | 4/1972 | Hagen | 335/199 |
| 4,509,028 | A * | 4/1985 | Muller | 335/202 |
| 5,677,656 | A * | 10/1997 | Mauch et al. | 335/126 |
| 5,936,496 | A * | 8/1999 | Kern | 335/80 |
| 5,994,986 | A * | 11/1999 | Takahashi | 335/78 |
| 7,825,756 | B2 * | 11/2010 | Takeda | 335/78 |
| 2003/0030520 | A1 * | 2/2003 | Hoffmann | 335/80 |
| 2004/0140873 | A1 * | 7/2004 | Funayama et al. | 335/128 |
| 2004/0212467 | A1 * | 10/2004 | Schwenkedel et al. | 335/128 |
| 2004/0246080 | A1 * | 12/2004 | Tanaka et al. | 335/128 |
| 2005/0219019 | A1 * | 10/2005 | Braun et al. | 335/126 |
| 2006/0226938 | A1 * | 10/2006 | Takeda et al. | 335/128 |

FOREIGN PATENT DOCUMENTS

| | | |
|---|---|---|
| JP | 06-223697 | 8/1994 |

* cited by examiner

*Primary Examiner* — Bernard Rojas

(74) *Attorney, Agent, or Firm* — IPUSA, PLLC

(57) ABSTRACT

An electromagnetic relay includes a coil, an armature that is electromagnetically attracted by the coil when current flows through the coil, two fixed contacts, a movable spring disposed to be movable to the fixed contacts, a conductive plate that is connected to the movable spring and including two movable contacts. The movable contacts are brought in contact with the fixed contacts respectively via the movable spring by the armature attracted by the coil. When the fixed contacts and the movable contacts are in contact, the fixed contacts are electrically connected to each other via the conductive plate. The movable spring is made of an insulating material.

5 Claims, 6 Drawing Sheets

ELECTROMAGNETIC RELAY

BACKGROUND OF THE INVENTION

1. Field of the Invention

This invention relates to an electromagnetic relay.

2. Description of the Related Art

Conventionally, an electromagnetic relay using a coil in which turns of wire are wound on an iron core is known. The electromagnetic relay is provided to supply electric power when a current flows through the coil and terminal contacts are brought in contact with each other by an electromagnetic force of the coil. To set the contacts in an ON or OFF state, a spring or the like is used in the electromagnetic relay and at least one of the contacts is connected to the spring. For example, Japanese Laid-Open Patent Publication No. 06-223697 discloses an electromagnetic relay of this type.

However, when a large-current or high-voltage electric power is supplied by the electromagnetic relay according to the related art, problems of power loss and safety arise. In order to reduce the power loss and improve the safety, it is undesirable that current flows in portions of the electromagnetic relay other than the portion needed for supplying the electric power.

SUMMARY OF THE INVENTION

In one aspect of the invention, the present disclosure provides an electromagnetic relay in which a current flows only in the necessary minimum portion of the electromagnetic relay for supplying electric power to improve safety and reduce power loss.

In an embodiment of the invention which solves or reduces one or more of the above-mentioned problems, the present disclosure provides an electromagnetic relay including: a coil; an armature that is electromagnetically attracted by the coil when current flows through the coil; two fixed contacts; a movable spring disposed to be movable to the fixed contacts; a conductive plate connected to the movable spring and including two movable contacts, the movable contacts being brought in contact with the fixed contacts respectively via the movable spring by the armature attracted by the coil, wherein, when the fixed contacts and the movable contacts are in contact, the fixed contacts are electrically connected to each other via the conductive plate, and wherein the movable spring is made of an insulating material.

In an embodiment of the invention which solves or reduces one or more of the above-mentioned problems, the present disclosure provides an electromagnetic relay including: a coil; an armature that is electromagnetically attracted by the coil when current flows through the coil; two fixed contacts; a movable spring disposed to be movable to the fixed contacts; a conductive plate connected to the movable spring and including two movable contacts, the movable contacts being brought in contact with the fixed contacts respectively via the movable spring by the armature attracted by the coil, wherein, when the fixed contacts and the movable contacts are in contact, the fixed contacts are electrically connected to each other via the conductive plate, and wherein the movable spring is made of a leaf spring.

Other objects, features and advantages of the invention will become more apparent from the following detailed descriptions when read in conjunction with the accompanying drawings.

DETAILED DESCRIPTION OF THE PREFERRED EMBODIMENTS

A description will be given of embodiments of the invention with reference to the accompanying drawings.

Figure 1:
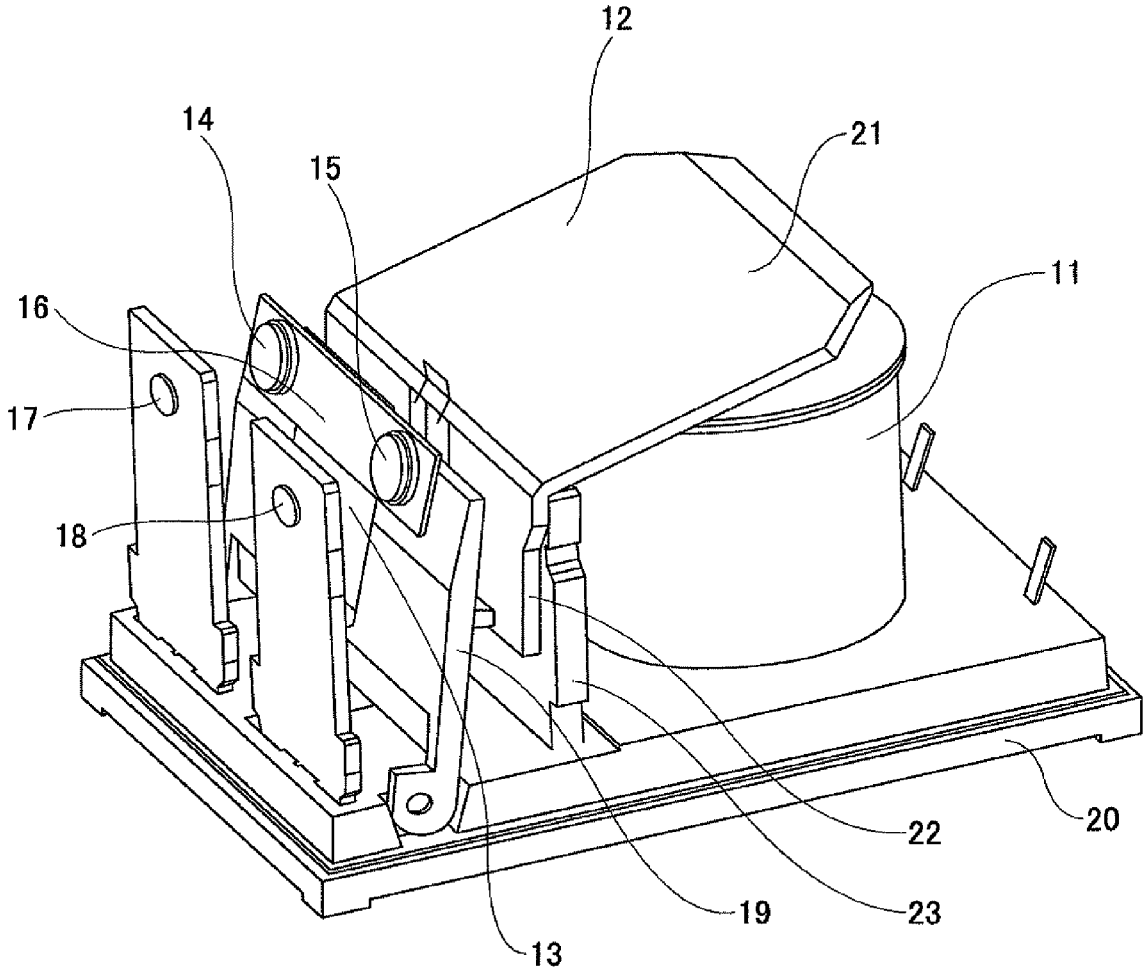
FIG. 1 is a perspective view of an electromagnetic relay of a first embodiment of the invention.

FIG. 1 illustrates an electromagnetic relay of a first embodiment of the invention.

As illustrated in FIG. 1, the electromagnetic relay of this embodiment includes a coil 11, an armature 12, a movable spring 13, a conductive plate 16 including two movable contacts 14 and 15, and two fixed contacts 17 and 18, which are disposed on a base frame 20.

In the coil 11, turns of copper wire are wound on an iron core. The coil 11 functions as an electromagnet when current flows through the copper wire.

The armature 12 is made of a soft magnetic material, such as iron. The armature 12 is configured into an L-shaped structure and includes a top plate part 21 and a side part 22. The armature 12 is disposed on an upper part of a yoke 23. When current flows through the coil 11, the top plate part 21 of the armature 12 is electromagnetically attracted by and brought in contact with the coil 11.

The movable spring 13 is made of an elastic insulating material and is configured into the shape of a leaf spring. When the armature 12 is moved, the side part 22 of the armature 12 pushes the movable spring 13 through a card 19 so that the movable spring 13 is bent by the armature 12. The conductive plate 16 is connected to the movable spring 13. The two movable contacts 14 and 15 on the conductive plate 16 at this time are brought in contact with the two fixed contacts 17 and 18, respectively.

The conductive plate 16 is made of a conductive material, such as copper. The fixed contact 17 is connected to a power supply (not illustrated). When the movable contacts 14 and 15 are brought in contact with the fixed contacts 17 and 18 respectively, the current supplied from the power supply (not illustrated) flows into the fixed contact 18 via the conductive plate 16. That is, when the movable contacts 14 and 15 on the conductive plate 16 and the fixed contacts 17 and 18 are in contact, the fixed contact 17 and the fixed contact 18 are electrically connected to each other via the conductive plate 16.

The movable spring 13 in this embodiment is made of an insulating material. Current does not flow in portions of the electromagnetic relay other than the fixed contacts 17 and 18 (and the electrodes connected to the fixed contacts 17 and 18), the movable contacts 14 and 15, and the conductive plate 16. Even when a large-current or high-voltage electric power is supplied, it is possible to improve the safety of the electromagnetic relay in supplying the electric power. In other words, current flows only in the necessary minimum portion of the electromagnetic relay, and it is possible to reduce the possibility of an electric shock or a leakage of current. The material of the movable spring 13 can be chosen from insulating materials, and the scope of selection of a spring material can be broadened.

In this embodiment, the movable spring 13 may be made of an elastic insulating material which is selected from a group including polyacetal, polybutylene-terephthalate, polycarbonate, and a hard rubber. These materials are elastic insulating materials, and they are usable as a spring material.

In this embodiment, the movable spring 13 is connected at one end to the base frame 20 of the electromagnetic relay. There are two kinds of the connection method to connect the movable spring 13 and the base frame 20. One method is to connect the movable spring 13 and the base frame 20 together by press fitting. The other method is to form the movable spring 13 and the base frame 20 by double molding or integral molding. When the movable spring 13 and the base frame 20 are formed by double molding or integral molding, the accuracy of positioning of the movable spring 13 and the base frame 20 at the time of formation can be improved, and the electromagnetic relay can be manufactured with low cost in a short time.

Alternatively, the movable spring 13 and the base frame 20 of the electromagnetic relay may be formed of a same insulating material.

Next, some methods of connecting the movable spring and the conductive plate in the first embodiment will be described with reference to FIG. 2A, FIG. 2B and FIG. 2C.

Figure 2A:
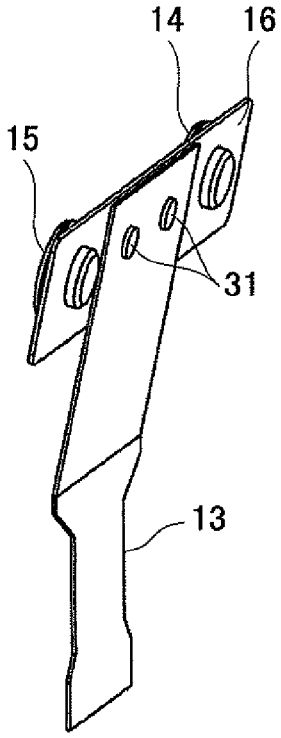
FIG. 2A, FIG. 2B and FIG. 2C are diagrams for explaining some methods of connecting a movable spring and a conductive plate in the electromagnetic relay of the first embodiment.

In the connection method as illustrated in FIG. 2A, the movable spring 13 and the conductive plate 16 are connected together by crimped metal pieces 31.

Figure 2B:
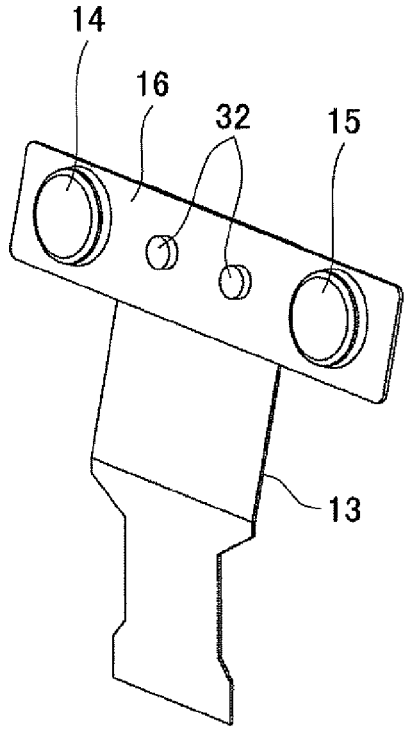

In the connection method as illustrated in FIG. 2B, the conductive plate 16 is formed with openings, the material which constitutes the movable spring 13 is heated so that the fused material flows into the openings in the conductive plate 16, and retaining parts 32 are formed with the movable spring 13 to connect the conductive plate 16 and the movable spring 13 together.

Figure 2C:
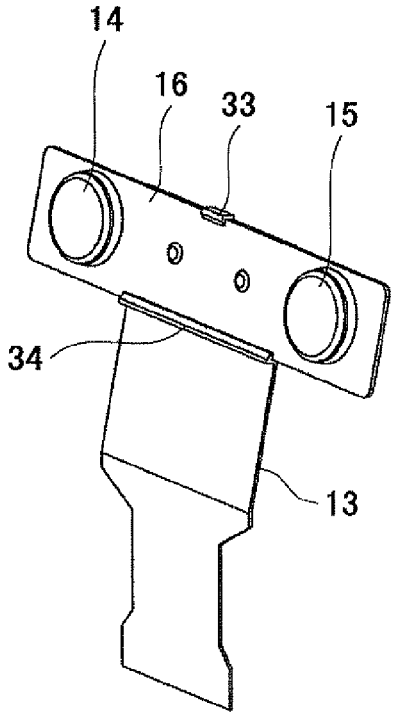

In the connection method as illustrated in FIG. 2C, nail-like projection parts 33 and 34 are disposed in the movable spring 13, and the upper and lower end faces of the conductive plate 16 are held by the projection parts 33 and 34.

Figure 3A:
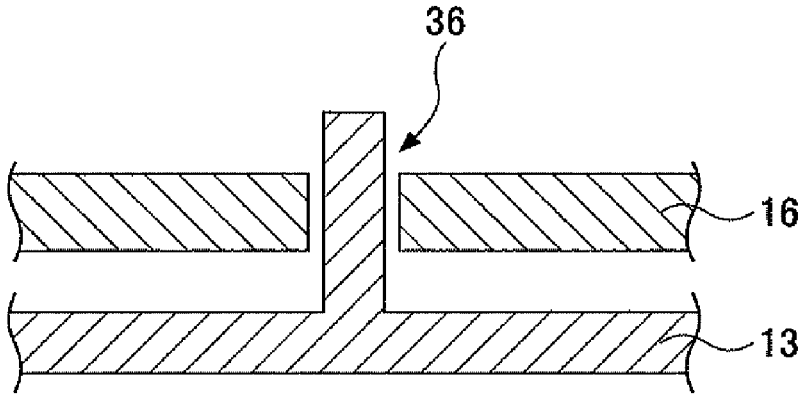
FIG. 3A and FIG. 3B are diagrams for explaining the method of connecting the movable spring and the conductive plate illustrated in FIG. 2B.

More specifically, the method of connecting the movable spring and the conductive plate illustrated in FIG. 2B will be described with reference to FIG. 3A and FIG. 3B.

First, a thermoplastic resin (which is an insulating material) which constitutes the movable spring 13 is placed next to the conductive plate 16 in which the opening 36 is formed, and the thermoplastic resin is heated. Thereby, as illustrated in FIG. 3A, the fused resin material flows into the opening 36 in the conductive plate 16 and reaches the opposite side end of the mold (not illustrated).

Figure 3B:
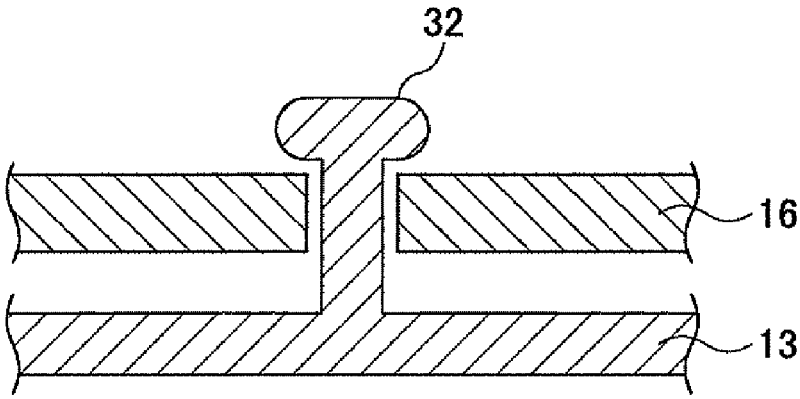

Subsequently, as illustrated in FIG. 3B, the tip of the resin material having reached the opposite side end of the mold is deformed to form the retaining part 32. As a result of cooling and solidifying of the resin material, the conductive plate 16 and the movable spring 13 are connected together by the retaining part 32.

Next, a description will be given of an electromagnetic relay of a second embodiment of the invention with reference to FIG. 4.

Figure 4:
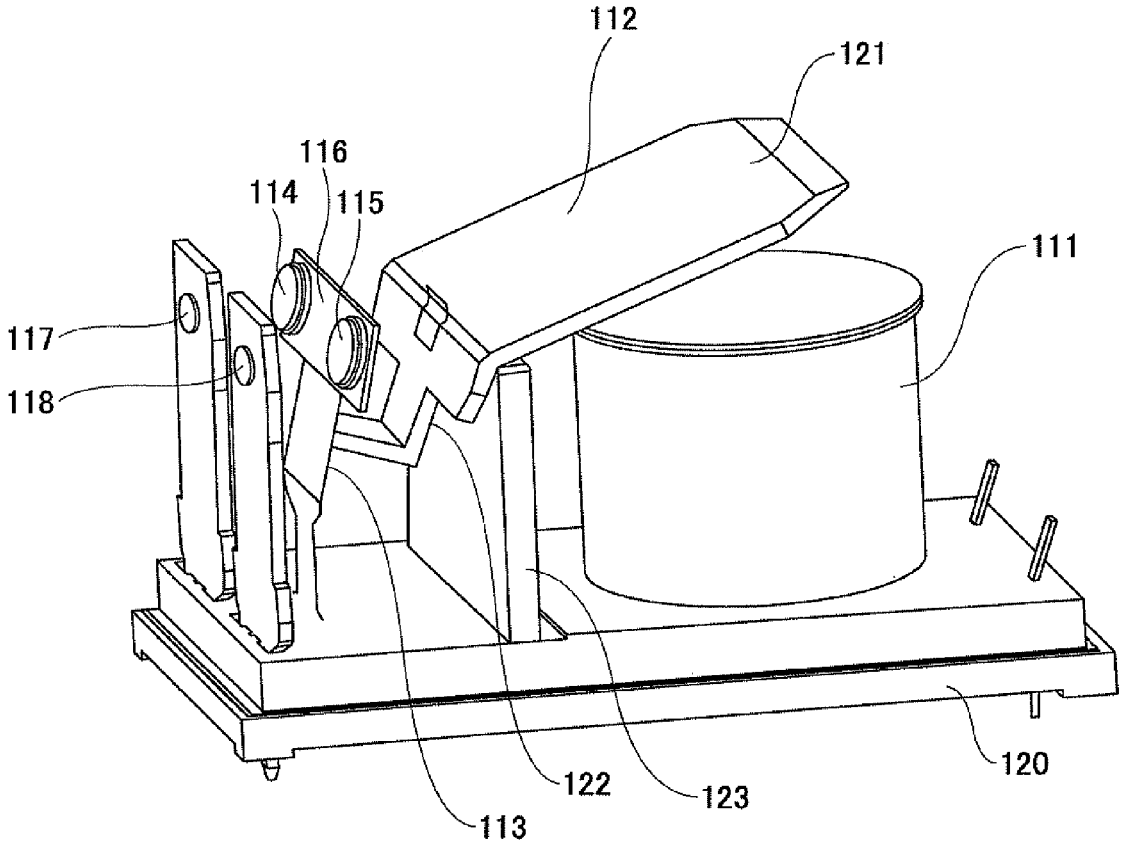
FIG. 4 is a perspective view of an electromagnetic relay of a second embodiment of the invention.

As illustrated in FIG. 4, the electromagnetic relay of this embodiment includes a coil 111, an armature 112, a movable spring 113, a conductive plate 116 including two movable contacts 114 and 115, and two fixed contacts 117 and 118, which are disposed on a base frame 120. The electromagnetic relay of this embodiment is constructed without using a card.

In the coil 111, turns of copper wire are wound on an iron core. The coil 111 functions as an electromagnet when current flows through the copper wire.

The armature 112 is made of a soft magnetic material, such as iron. The armature 112 is configured into an L-shaped structure and includes a top plate part 121 and a side part 122. The armature 112 is disposed on an upper part of a yoke 123. When current flows through the coil 111, the top plate part 121 of the armature 112 is electromagnetically attracted by and brought in contact with the coil 111.

The movable spring 113 is made of an elastic insulating material and is configured into the shape of a leaf spring. When the armature 112 is moved, the side part 122 of the armature 112 pushes the movable spring 113 directly so that the movable spring 113 is bent by the armature 112. The conductive plate 116 is connected to the movable spring 113. The two movable contacts 114 and 115 on the conductive plate 116 at this time are brought in contact with the two fixed contacts 117 and 118, respectively.

The conductive plate 116 is made of a conductive material, such as copper. The fixed contact 117 is connected to a power supply (not illustrated). When the movable contacts 114 and 115 are brought in contact with the fixed contacts 117 and 118 respectively, the current supplied from the power supply (not illustrated) flows into the fixed contact 118 via the conductive plate 116. That is, when the movable contacts 114 and 115 on the conductive plate 116 and the fixed contacts 117 and 118 are in contact, the fixed contact 117 and the fixed contact 118 are electrically connected to each other via the conductive plate 116.

The movable spring 113 in this embodiment is made of an insulating material. Current does not flow in portions of the electromagnetic relay other than the fixed contacts 117 and 118 (and the electrodes connected to the fixed contacts 117 and 118), the movable contact 114 and 115, and the conductive plate 116. Even when a large-current or high-voltage electric power is supplied, it is possible to improve the safety of the electromagnetic relay in supplying the electric power. In other words, current flows only in the necessary minimum portion of the electromagnetic relay, and it is possible to reduce the possibility of an electric shock or a leakage of current. The material of the movable spring 113 can be chosen from insulating materials, and the scope of selection of a spring material can be broadened.

In this embodiment, the movable spring 113 is made of an insulating material and the card of an insulating material as in the first embodiment is not required. Hence, the number of component parts and the number of assembly processes can be reduced, and the electromagnetic relay can be manufactured with low cost.

The method of connecting or forming of the movable spring 113 and the base frame 120, and the method of connecting or forming of the movable spring 113 and the conductive plate 116 in this embodiment are essentially the same as those in the first embodiment, and a description thereof will be omitted.

Next, a description will be given of an electromagnetic relay of a third embodiment of the invention with reference to FIG. 5.

Figure 5:
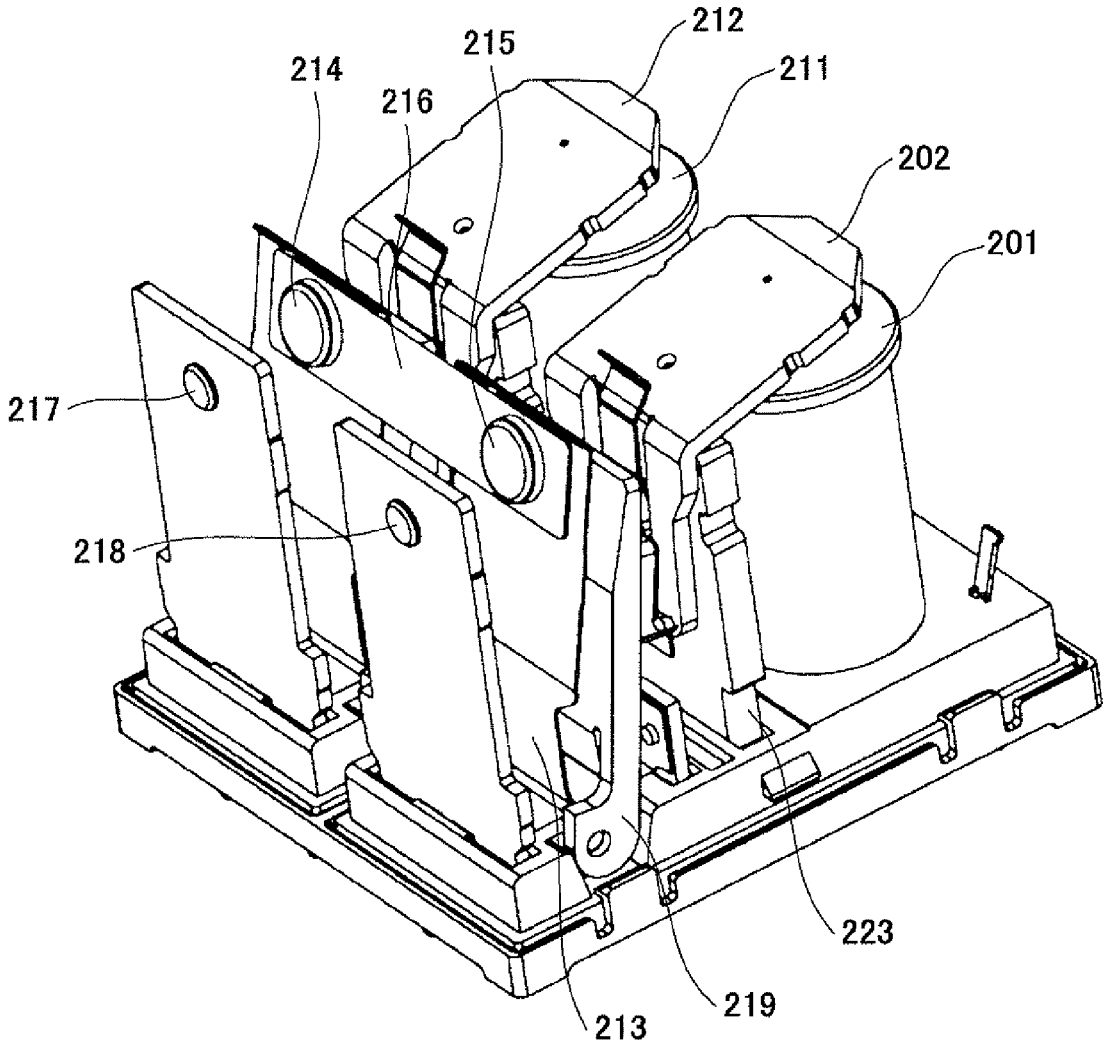
FIG. 5 is a perspective view of an electromagnetic relay of a third embodiment of the invention.

As illustrated in FIG. 5, the electromagnetic relay of this embodiment includes two coils 201 and 211, two armatures 202 and 212, two movable springs 213, a conductive plate 216 including two movable contacts 214 and 215 and which is connected to the movable springs 213, and two fixed contacts 217 and 218, which are disposed on a base frame.

In each of the coils 201 and 211, turns of copper wire are wound on an iron core. Each of the coils 201 and 211 functions as an electromagnet when current flows through the copper wire.

Each of the armatures 202 and 212 is made of a soft magnetic material, such as iron. Each of the armatures 202 and 212 is configured into an L-shaped structure and includes a top plate part and a side part. Each of the armatures 202 and 212 is disposed on an upper part of a yoke 223. When current flows through the coils 201 and 211, the top plate part of the armature 202 is electromagnetically attracted by and brought in contact with the coil 201, and the top plate part of the armature 212 is electromagnetically attracted by and brought in contact with the coil 211. The movement of the armature 202 and the movement of the armature 212 may be controlled independently of each other.

Each of the movable springs 213 is made of a leaf spring of an elastic material. When the armatures 202 and 212 are moved, the side parts of the armatures 202 and 212 respectively push the movable springs 213 through a card 219 so that the movable springs 213 are bent by the armatures 202 and 212. At this time, the two movable contacts 214 and 215 on the conductive plate 216 connected to the movable springs 213 are brought in contact with the two fixed contacts 217 and 218 respectively.

Figure 6:
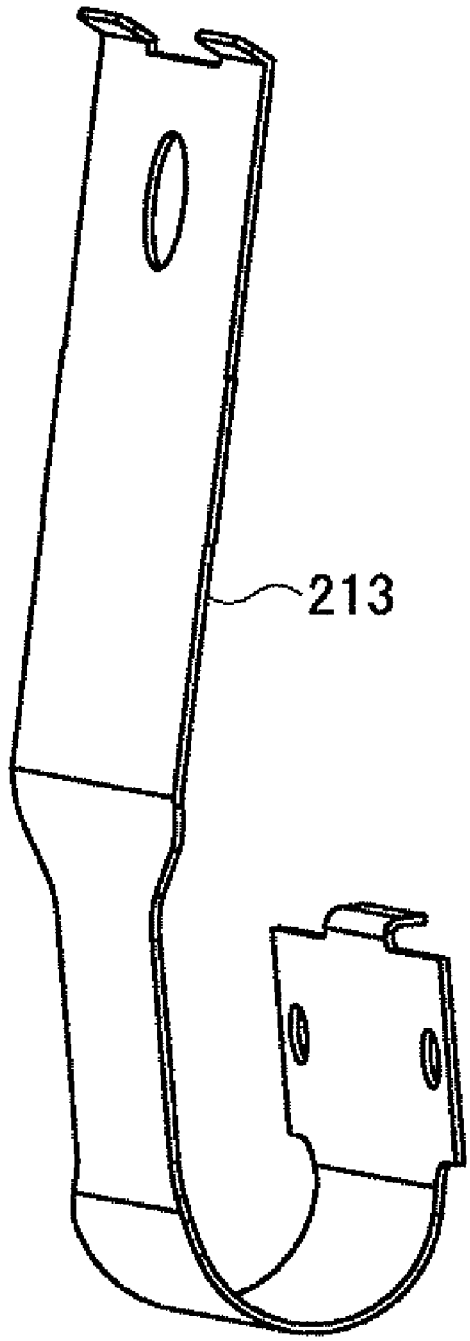
FIG. 6 is a perspective view of a leaf spring in the electromagnetic relay of the third embodiment.

In this embodiment, each of the movable springs 213 is made of a metallic leaf spring which is configured into a U-shaped structure as illustrated in FIG. 6.

The conductive plate 216 is made of a conductive material, such as copper. The fixed contact 217 is connected to a power supply (not illustrated). When the movable contacts 214 and 216 are brought in contact with the fixed contacts 217 and 218 respectively, the current supplied from the power supply (not illustrated) flows into the fixed contact 218 via the conductive plate 216. That is, when the movable contacts 214 and 215 on the conductive plate 216 and the fixed contacts 217 and 218 are in contact, the fixed contact 217 and the fixed contact 218 are electrically connected to each other via the conductive plate 216.

In this embodiment, the two coils 201 and 211, the two armatures 202 and 212, and the two movable springs 213 are arranged, and it is possible to remarkably increase the working force of the electromagnetic relay to operate the movable springs 213. Even when it is required to apply a high voltage to the coils 201 and 211, the high voltage to be applied may be reduced to a lowered voltage and the lowered voltage may be applied to each of the coils 201 and 211.

Similarly, the electromagnetic relays of the previously described first and second embodiments may also be arranged to include a plurality of coils, a plurality of armatures, and a plurality of movable springs. Such modifications provide the advantageous features that are the same as those of the third embodiment mentioned above.

As described in the foregoing, the electromagnetic relay according to the invention can reduce the power loss and improve the safety in supplying electric power. Especially, the electromagnetic relay according to the invention is appropriate for the cases where a large-current or high-voltage electric power is supplied.

The present invention is not limited to the specifically disclosed embodiments, and variations and modifications may be made without departing from the scope of the present invention.

The present application is based on Japanese patent application No. 2008-236192, filed on Sep. 16, 2008, the contents of which are incorporated herein by reference in their entirety.

What is claimed is:

1. An electromagnetic relay comprising:

a coil;

an armature that is electromagnetically attracted by the coil when current flows through the coil;

two fixed contacts;

a movable spring disposed to be movable to the fixed contacts;

a conductive plate connected to the movable spring and including two movable contacts, the movable contacts being brought in contact with the fixed contacts respectively via the movable spring by the armature attracted by the coil, wherein, when the fixed contacts and the movable contacts are in contact, the fixed contacts are electrically connected to each other via the conductive plate, wherein the movable spring is made of an insulating material and includes retaining parts of the insulating material integrally formed in the movable spring to connect the movable spring and the conductive plate together, and wherein the movable spring is connected at one end to a base frame of the electromagnetic relay, and when the armature attracted by the coil is moved, the movable spring is bent by the armature so that the movable contacts of the conductive plate connected to the movable spring are brought in contact with the fixed contacts.

2. The electromagnetic relay according to claim 1, wherein the movable spring is made of an elastic insulating material which is selected from a group including polyacetal, polybutylene-terephthalate, polycarbonate, and a hard rubber.

3. The electromagnetic relay according to claim 1, wherein the movable spring and the base frame of the electromagnetic relay are connected together by press fitting.

4. The electromagnetic relay according to claim 1, wherein the movable spring and the base frame of the electromagnetic relay are formed by double molding or integral molding.

5. The electromagnetic relay according to claim 1, wherein the movable spring and the base frame of the electromagnetic relay are formed of a same material.

* * * * *